United States Patent [19]

Kurushima et al.

[11] Patent Number: 4,481,766

[45] Date of Patent: Nov. 13, 1984

[54] YARN DRAW OFF TUBE FOR OPEN-END SPINNING UNIT

[75] Inventors: Tadanori Kurushima; Kiyoshi Takeshita, both of Kariya; Kazuo Kamiya, Nishio, all of Japan

[73] Assignee: Kabushiki Kaisha Toyoda Jidoshokki Seisakusho, Aichi, Japan

[21] Appl. No.: 454,181

[22] Filed: Dec. 29, 1982

[30] Foreign Application Priority Data

Dec. 29, 1981 [JP] Japan ..... 56-214821

[51] Int. Cl.[3] ..... D01H 1/135; D01H 13/04

[52] U.S. Cl. ..... 57/417; 57/352

[58] Field of Search ..... 57/404, 414, 417, 352

[56] References Cited

U.S. PATENT DOCUMENTS 3,336,741 8/1967 Zavadsky et al. ..... 57/417

3,336,742 8/1967 Stary et al. ..... 57/417

3,778,989 12/1973 Schon ..... 57/417

3,789,597 2/1974 Schon ..... 57/417

3,834,147 9/1974 Havranek et al. ..... 57/417

3,965,661 6/1976 Yoshida ..... 57/417

*Primary Examiner*—John Petrakes

*Attorney, Agent, or Firm*—Burgess, Ryan & Wayne

[57] ABSTRACT

A yarn draw off tube for an open-end spinning unit which improves the twist transmission to a fiber ribbon in a spinning rotor. The yarn draw off tube is provided with a yarn inlet on the top wall thereof and a yarn outlet on the lower side wall thereof, and the yarn inlet is eccentric from the center in a direction opposite to the yarn outlet. In the spinning operation, a twist imparted to a yarn drawn off from the spinning rotor can smoothly be transmitted to the root portion thereof. Thereby, yarn breakage is restrained and a yarn of good appearance and strength can be obtained.

4 Claims, 10 Drawing Figures

Fig. 1
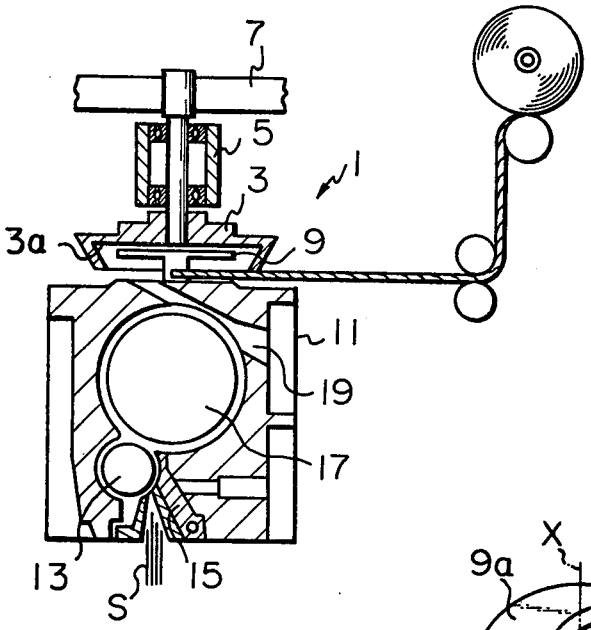
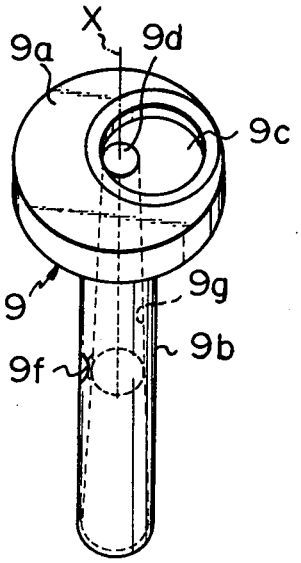
Fig. 2

YARN DRAW OFF TUBE FOR OPEN-END SPINNING UNIT

BACKGROUND OF THE INVENTION

Description of the Prior Art

This invention relates to a yarn draw off tube for an open-end spinning unit.

It is desirable to produce a soft twist yarn having less fluffs by means of a rotor-type open-end spinning unit. However, it is very difficult to produce such a yarn of an evenly distributed less twist as mentioned above by means of an open-end spinning unit for various reasons. First, in an open-end spinning unit, a fiber ribbon deposited on a fiber-collecting surface of a spinning rotor is twisted to form a yarn due to rotation of the spinning rotor while the fiber ribbon is being drawn off from the rotor. The root portion of the yarn which merges into the fiber ribbon on the fiber-collecting surface has less of a twist density than does the other portion of the yarn, and, therefore, yarn breakage often occurs in this portion. This tendency is naturally remarkable in the case of soft twist yarn. To improve the twist density of the yarn root portion, various proposals have been made. For example, in Japanese Unexamined Patent Publication (Kokai) No. 49-132329, a yarn draw off tube provided with a high frictional surface is disposed so as to confront the spinning rotor, thereby imparting a false twist to the yarn. Further, in Japanese Examined Patent Publication (Kokoku) No. 43-24978, an eccentric yarn draw off tube is proposed for improving the twist transmission to the root portion of the yarn. In the case of the former yarn draw off tube, however, the produced yarn becomes fluffy or has snarled fibers in its structure due to excessive rubbing of the frictional surface. In the case of the latter tube, the twist is not satisfactorily transmitted. On the contrary, the yarn tension fluctuates sharply, thereby causing yarn breakage or an uneven thickness.

SUMMARY OF THE INVENTION

It is an object of the present invention to provide a yarn draw off tube for an open-end spinning unit which can satisfactorily transmit a twist to the root portion of a yarn during the spinning operation and which can produce a soft twist yarn having few fluffs and a good evenness. To achieve the above-mentioned object, the yarn draw off tube according to the present invention has a yarn inlet eccentric from the center axis of the tube at a specific distance as well as deviating in a specific direction relative to the yarn outlet.

BRIEF DESCRIPTION OF THE DRAWINGS

Other objects and features of the present invention will be apparent from the following description of the embodiments made with reference to the accompanying drawings, in which:

FIG. 1 is a sectional side view of an embodiment according to the present invention;

FIG. 2 is an oblique view of a yarn draw off tube according to the present invention;

DETAILED DESCRIPTION OF THE INVENTION

Figure 3:
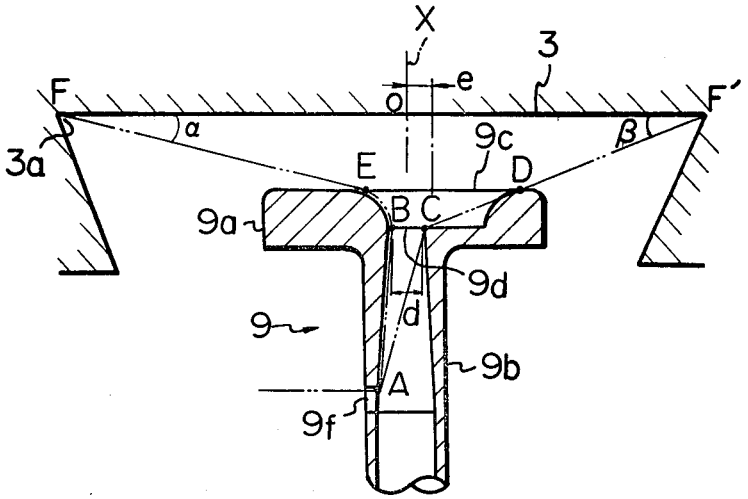
FIGS. 3 and 4 are side sectional views diagrammatically illustrating the yarn paths from the spinning rotor to the yarn draw off tube.

As is shown in FIG. 1, an open-end spinning unit 1 according to the present invention comprises a spinning rotor 3 rotatably supported on a stationary part by a bearing 5 and driven by a belt 7 and a yarn draw off tube 9 fixedly secured to an outer wall of a housing 11 so as to confront the spinning rotor 3. The housing 11 is provided therein with a feed roller 13 for introducing a sliver S into the housing, a presser 15 urged onto the surface of the feed roller 13, a combing roller 17 for opening the sliver S to individual fibers, and a fiber-transporting duct 19 for conveying the individual fibers, along with an airstream, into the spinning rotor 3.

The yarn draw off tube 9, illustrated in FIG. 2, consists of a disc portion 9*a* and a tube portion 9*b* extending from the center of the disc portion 9*a*. The disc portion 9*a* has a circular yarn inlet 9*c* eccentric from an axis X of the tube portion 9*b*. The tube portion 9*b* has a guide channel 9*g* extending through its body along the axis X. The guide channel 9*g* widens toward the bottom of the tube portion 9*b* and is connected to the yarn inlet 9*c* through an aperture 9*d* at the top of the tube portion 9*b*. On a side wall of the guide channel 9*g* is provided a yarn outlet 9*f*. In this connection, the center of the yarn inlet 9*c* deviates opposite to the yarn outlet 9*f* relative to the axis X (refer to FIG. 3).

The significance of the eccentricity of the inlet 9*c* is now explained more specifically with reference to FIGS. 3, 4, 5*a* to 5*d* and 6.

Figure 6:
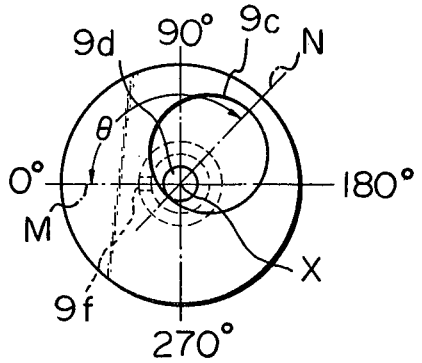
FIG. 6 is a top view of a yarn draw off tube illustrating an eccentric angle.

FIG. 3 shows the yarn paths as chain lines extending from a fiber-collecting surface 3*a* of the spinning rotor 3 to the yarn outlet 9*f* of the yarn draw off tube 9 through the yarn inlet 9*c*. One twist is imparted to a yarn portion existing between point F or F′ on the fiber-collecting surface 3*a* and point A in the outlet 9*f* by one revolution of the rotor 3 about the axis X. The twisting occurs at first at point A, farthest from the rotor along the axis X, and the twist is transmitted sequentially upstream along the yarn and finally reaches point F or F′. If the yarn contacts the surface of other objects in the midportion of the yarn path, the twist transmission is more or less disturbed. The degree of easeness of twist transmission will now be explained in regard to various eccentric angles of the yarn inlet 9*c* of the yarn draw off tube 9, where the eccentric angle $\theta$, shown in FIG. 6, is an angle between the axis M of the yarn outlet 9*f* (the axis M corresponds to a 0°–180° line) and the diameter N of the yarn inlet 9*c* passing through the axis X of the tube portion 9*b*. The eccentric angle is measured in a clockwise direction from the axs M.

Figure 5A:
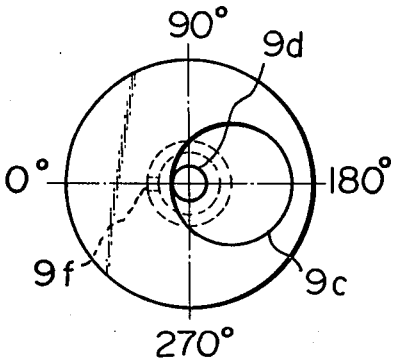
FIGS. 5*a* to 5*d* are top views of yarn draw off tubes having yarn inlets with different eccentricities.

The yarn draw off tube shown in FIG. 3 has an eccentric angle of 180°, that is the yarn inlet 9*c* deviates in a direction opposite to that of the yarn outlet 9*f* relative to the axis X, as is shown in FIG. 5*a*.

In the area from 270° to 90° about the axis X in a clockwise direction, the mean yarn path passes through points A, B, E, and F of FIG. 3, where A is a point at the yarn outlet 9*f*, B and C are points on the bottom edge of the yarn inlet 9*c*; and D and E are points on the top edge of the yarn outlet 9*c*. Since the yarn contacts the surface of the yarn draw off tube 9 at $\overline{AB}$ and $\overline{BE}$, and, further, since the tangential angle $\alpha$ at E relatively small, a twist cannot be smoothly transmitted from A to F. Rather, it accumulates mainly in the portion between A and B. On the contrary, in the area from 90° to 270° in a clockwise direction, the mean yarn path passes through the points A, C, D and F' of FIG. 3. Since the surface-contact of the yarn is less than that in the area from 270° to 90° and the tangential angle $\beta$ at D is relatively large, a twist can be easily transmitted from A to F'. Thus, in the latter area, the accumulated twist in the preceding area and the newly generated twist are simultaneously discharged toward F'. In other words, in the case of the yarn draw off tube of FIG. 5*a*, the twist is discharged and transmitted smoothly within a half path per one rotation of the spinning rotor.

Figure 4:
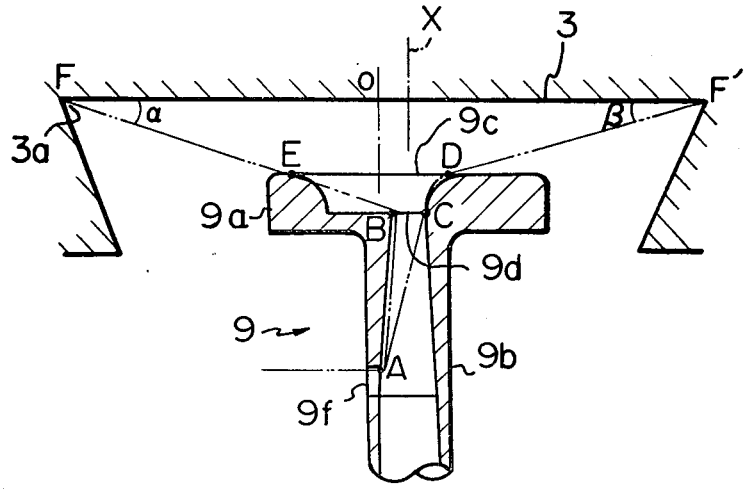
Figure 5B:
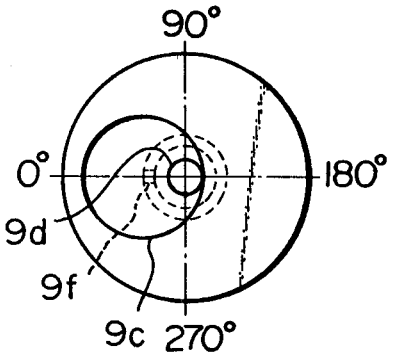

Contrary to this, in the case of the yarn draw off tube 9 shown in FIG. 4, the yarn inlet 9*c* deviates in the same direction as the yarn outlet 9*f* relative to the axis X, as shown in FIG. 5*b*. In the area from 270° to 90°, the yarn contacts the surface of the guide channel 9*g* at $\overline{AB}$, and, as a result, a twist cannot be transmitted from A to F. On the other hand, in the area from 90° to 270°, the yarn contacts the wall of the yarn inlet 9*c* at $\overline{CD}$, resulting in a poor twist transmission. Accordingly, the twist imparted to the yarn portion at A cannot ascend smoothly toward F or F' in one rotation and instead accumulates in the yarn portion between A and B until the torque of the yarn portion overcomes the frictional resistance of the yarn path. As a result, the twist distribution along the produced yarn becomes uneven, resulting in yarn breakage and yarn of poor quality.

Figure 5C:
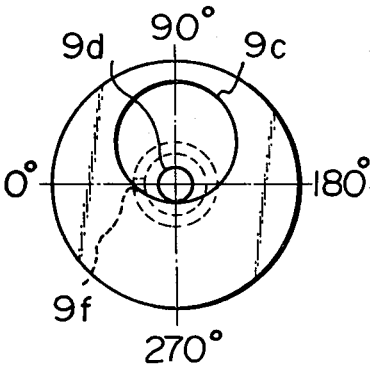
Figure 5D:
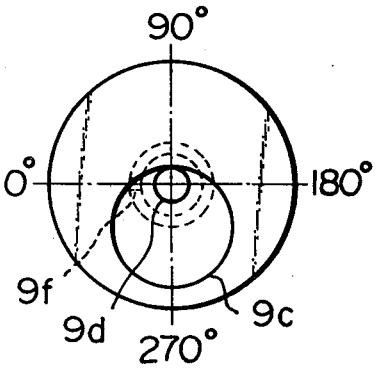

The above analysis can be applied to the yarn draw off tubes shown in FIGS. 5*c* and 5*d*, the tube in FIG. 5*c* having a yarn inlet 9*c* with an eccentric angle of 90° and the tube in FIG. 5*d* having an eccentric angle of 270°, respectively. The results of analysis of the ease of twist transmission are as follows, relating the angles not enclosed in brackets relating to the tube shown in FIG. 5*c* and the angles enclosed in brackets relating to the tube shown in FIG. 5*d*:

1. In the area from 270° to 90° (from 270° to 90°), the twist transmission is poor.
2. In the area from 90° to 180° (from 180° to 270°), the twist transmission is smooth.
3. In the area from 180° to 270° (from 90° to 180°), the twist transmission is poor.

This means that the twist distribution in the yarns produced by means of the yarn draw off tubes of FIGS. 5*b*, 5*c*, and 5*d* are all more uneven than that produced by means of the yarn draw off tube of FIG. 5*a*.

The above-mentioned analysis is summarized in Table 1. In Table 1, O and X represent good twist transmission and poor twist transmission, respectively.

TABLE 1

| Eccentric Angle ($\theta$°) | Area ($\phi$°) | Section of yarn path $\overline{AB}$ | $\overline{BE}$ | $\overline{EF}$ | $\overline{AC}$ | $\overline{CD}$ | $\overline{DF}$ | FIG. |
|---|---|---|---|---|---|---|---|---|
| 180 | 270~0 | x | x | x | — | — | — | 5a |
| | 0~90 | x | x | x | — | — | — | |
| | 90~180 | — | — | — | o | o | o | |
| | 180~270 | — | — | — | o | o | o | |
| 0 | 270~0 | x | o | o | — | — | — | 5b |
| | 0~90 | x | o | o | — | — | — | |
| | 90~180 | — | — | — | o | x | x | |
| | 180~270 | — | — | — | o | x | x | |
| 90 | 270~0 | x | x | x | — | — | — | 5c |
| | 0~90 | x | o | o | — | — | — | |
| | 90~180 | — | — | — | o | o | o | |

TABLE 1-continued

| Eccentric Angle ($\theta$°) | Area ($\phi$°) | Section of yarn path $\overline{AB}$ | $\overline{BE}$ | $\overline{EF}$ | $\overline{AC}$ | $\overline{CD}$ | $\overline{DF}$ | FIG. |
|---|---|---|---|---|---|---|---|---|
| | 180~270 | — | — | — | o | x | x | |
| 270 | 270~0 | x | o | o | — | — | — | 5d |
| | 0~90 | x | x | x | — | — | — | |
| | 90~180 | — | — | — | o | x | x | |
| | 180~270 | — | — | — | o | o | o | |

As is apparent from Table 1, the yarn draw off tube having a yarn inlet deviating just opposite to the yarn outlet, i.e., a yarn inlet having an eccentric angle of 180°, has the widest area for good twist transmission during each revolution of the spinning rotor.

In order to obtain optimum conditions concerning the deviated position of the yarn inlet 9*c*, the present inventors performed various types of experiments, the results of which are explained below.

1. Eccentric radius e of the yarn inlet 9*c* from the axis X

The eccentric radiuse of the yarn inlet 9*c* also has an effect on twist transmission (refer to FIG. 3). The present inventors performed an experiment in an attempt to discover the optimum range of the eccentric radius e. Five runs were carried out in the experiment, in which a 32's (cotton counts) yarn was spun from a sliver composed of 30% polyester staple fibers having a fineness of 1.3 denier and a length of 35 mm and 70% of cotton by means of five spinning units, each of which had the yarn draw off tube shown in FIG. 5*a*. All of the tubes were the same size except for the eccentric radius e. The other test conditions were as follows:

| | |
|---|---|
| Diameter of spinning rotor: | 50 mm |
| Rotational speed of spinning rotor: | 60,000 rpm |
| Combing roller: | 90° × 4.5 teeth/in. |
| Rotational speed of combing roller: | 7,000 rpm |
| Diameter d of aperture 9d: | 3.0 mm |

The resultant yarns were measured with regard to:

| | |
|---|---|
| Corrected lea breakage strength | L (kg) |
| Uster U % | U (%) |
| Number of fluffs exceeding 3 mm | F No./10 m |

The results are shown in Table 2.

TABLE 2

| Run No. | 1 | 2 | 3 | 4 | 5 |
|---|---|---|---|---|---|
| e (mm) | 0 | 1.0 | 2.0 | 3.0 | 4.0 |
| e/d | 0 | $\frac{1}{3}$ | $\frac{2}{3}$ | 1 | 4/3 |
| L (kg) | 23.1 | 25.1 | 25.8 | 24.2 | 22.3 |
| U (%) | 13.4 | 12.7 | 12.2 | 12.8 | 13.9 |
| F (No./10 m) | 79 | 35 | 26 | 25 | 30 |

As is apparent from Table 2, the yarn draw off tubes utilized for runs 2, 3, and 4 exhibited excellent results. Accordingly, the eccentricity e/d is preferably within a range of from $\frac{1}{3}$ to 1.

2. Eccentric angle $\theta$ of the yarn inlet 9*c*

The inventors performed another spinning experiment to confirm the results shown in Table 1 and to determine the preferred range of the eccentric angle. The experimental conditions were as follows:

| | |
|---|---|
| Produced yarn: 100% cotton, 7's | (cotton count) |
| Diameter of spinning rotor: | 50 mm |
| Rotational speed of spinning rotor: | 60,000 rpm |
| Combing roller: | 65° × 10 teeth/in. |
| Rotational speed of combing roller: | 8,000 rpm |
| Eccentric radius of yarn inlet: | 2 mm |
| Diameter of aperture: | 3.0 mm |

Eight runs, including one blank, were carried out in the experiment, with the eight spinning units having yarn draw off tubes of different eccentric angles. In each run, the yarn was taken up from the spinning rotor through the yarn draw off tube while increasingly varying the winding speed of the yarn, but keeping the rotational speed of the spinning rotor and the draft ratio constant. The draft ratio means the winding speed divided by the feeding speed of the sliver. The winding speed was increased to a critical speed at which the yarn fell down due to a lack of twist per unit yarn length. From the critical winding speed, a critical spinnable twist $T_c$ was calculated by using the following equation (1):

$$\text{critical spinnable twist } T_c = \frac{\text{rotational speed of spinning rotor (rpm)}}{\text{critical winding speed (m/min)}} \quad (1)$$

Then the critical twist coefficient $\alpha_c$ was calculated by using the following equation (2):

$$\text{critical twist coefficient } \alpha_c = \frac{T_c}{\sqrt{S}}, \quad (2)$$

where S represents the yarn count of the produced yarn.

Figure 7:
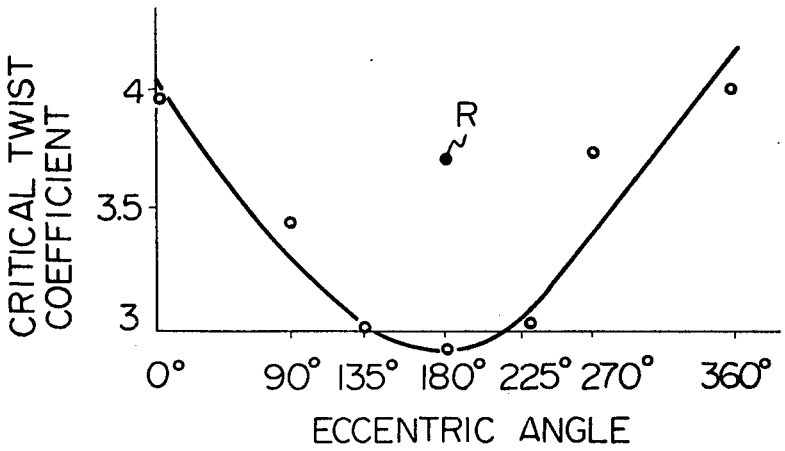
FIG. 7 is a graph showing the relationship between the critical twist coefficient and the eccentric angle of the inlet of the yarn draw off tube.

The results are represented by dots in the graph of FIG. 7. In the graph, the dot R represents, for the purpose of comparison, a value of a conventional yarn draw off tube having a non-eccentric yarn inlet.

As the value of the critical twist coefficient $\alpha_c$ becomes smaller, the spinning unit can spin a softer twist yarn having a good feel to the touch and has a high productivity. According to the graph, $\alpha_c$ is the smallest at an eccentric angle of 180° and increases as it becomes more distant from this point. Thus, it is apparent that the preferable range of the eccentric angle is from 135° to 225°.

According to the present invention, the spinnability of an open-end spinning unit is improved remarkably, and a yarn excellent in strength, as well as in appearance, can be obtained.

We claim:

1. A yarn draw off tube for an open-end spinning unit comprising a disc portion and a tube portion extending perpendicularly from the center of said disc portion, said disc portion being provided with a yarn inlet on a top wall thereof and said tube portion being provided with a yarn outlet on a side wall thereof and, further, with a guide channel extending along an axis thereof communicating said yarn inlet with said yarn outlet, said yarn drawing off tube being characterized in that said yarn inlet is eccentric from the axis of said tube portion and has an eccentric angle substantially in a direction opposite to said yarn outlet relative to said axis.

2. A yarn draw off tube according to claim 1, in which the eccentric radius of said yarn inlet is in the range of from $\frac{1}{3}$ to 1 relative to the smallest diameter d of said guide channel.

3. A yarn draw off tube according to claim 2, in which said eccentric angle of said yarn inlet is in the range of from 135° to 225° relative to said yarn outlet.

4. A yarn draw off tube according to claim 1, in which said eccentric angle of said yarn inlet is in the range of from 135° to 225° relative to said yarn outlet.

* * * * *